US006033144A

United States Patent [19]

Ng et al.

[11] Patent Number: 6,033,144

[45] **Date of Patent: *Mar. 7, 2000**

[54] RING BINDER MECHANISM

[75] Inventors: Weng Io Ng, Quarry Bay; Chun Yuen To, Shatin, both of The Hong Kong Special Administrative Region of the People's Republic of China

[73] Assignee: World Wide Stationary Mfg. Co., Ltd., The Hong Kong Special Administrative Region of the People's Republic of China

[ * ] Notice: This patent is subject to a terminal disclaimer.

[21] Appl. No.: 09/015,071

[22] Filed: Jan. 28, 1998

Related U.S. Application Data

[63] Continuation-in-part of application No. 08/915,732, Aug. 21, 1997.

[30] Foreign Application Priority Data

Aug. 22, 1996 [GB] United Kingdom ..... 9617569

[51] Int. Cl.[7] ..... B42F 3/04

[52] U.S. Cl. ..... 402/36; 402/26; 402/70; 402/73

[58] Field of Search ..... 402/26, 36–42, 402/70, 73, 75, 80 R, 502

[56] References Cited

U.S. PATENT DOCUMENTS

| | | | |
|---|---|---|---|
| 649,761 | 5/1900 | Saltzkorn et al. | 411/467 |
| 705,626 | 7/1902 | Vogel | 217/70 |
| 951,946 | 3/1910 | Force | 24/3.11 |
| 2,358,490 | 9/1944 | Uribe | 292/307 R |
| 2,612,813 | 10/1952 | Cohn | 411/461 |
| 2,728,514 | 12/1955 | Holtkamp | 411/466 |
| 4,641,474 | 2/1987 | Cannarsa | 52/514 |
| 4,697,945 | 10/1987 | Geiger | 402/75 |
| 5,100,253 | 3/1992 | Cooper | 402/75 |
| 5,160,209 | 11/1992 | Schuessler | 402/75 |
| 5,269,616 | 12/1993 | O'Neilll | 402/74 |
| 5,755,513 | 5/1998 | To | 402/36 |
| 5,772,348 | 6/1998 | To | 402/36 |
| 5,810,500 | 9/1998 | Whaley | 402/31 |
| 5,816,729 | 10/1998 | Whaley | 402/31 |

*Primary Examiner*—Willmon Fridie, Jr.
*Assistant Examiner*—Alisa L. Thurston
*Attorney, Agent, or Firm*—Hall, Priddy & Myers

[57] ABSTRACT

A ring binder mechanism adapted to be secured to a cover is disclosed as including a substantially rigid curved cover supporting a pair of plates to which a plurality of half-rings are mounted, and a pair of rivets for engagement with the cover, and the plates are pivotably movable between a first configuration in which the half-rings are closed, and a second configuration in which the half-rings are open, and each rivet includes an anchor plate adapted to abut the cover, and a row of three outer claws depend from each of two side edges of the anchor plate to secure the ring binder mechanism to the cover. Two rows of inner claws depending from the underside surface of the rivet, each row being adjacent to a respective row of outer claws, are also included to enhance the gripping action. The row of outer claws and the adjacent row of inner claws may point towards the same direction, or towards different directions.

30 Claims, 15 Drawing Sheets

RING BINDER MECHANISM

This application is a Continuation-In-Part of U.S. patent application Ser. No. 08/915,732 filed Aug. 21, 1997.

This invention relates to a ring binder mechanism and, in particular, such a mechanism which is adapted to be secured to an article, e.g. a cover, by securing means such as rivets. This invention also relates to a securing device for securing a ring binder mechanism to an article, e.g. a cover.

Conventional ring binder mechanisms include a substantially rigid upper cover supporting a pair of plates. To each of the plates are mounted a number of half-rings. The plates are pivotally movable relative to each other between a first configuration in which the half-rings are closed to retain loose-leaf paper, and a second configuration in which the half-rings are open to allow loose-leaf paper to be inserted into or taken out from the half rings. Such conventional ring binder mechanisms are usually secured to a cover by a pair of rivets, each near a longitudinal end of the ring binder mechanism. Such rivets generally include a head portion which is engaged with the cover of the mechanism, and a number of claws penetrable into the cover, and thereby to secure the ring binder mechanism to the cover.

Various methods and arrangements have been devised to enhance the engagement between the rivets and the cover, and thus between the ring binder mechanism and the cover. One such improvement involves the inclusion of an anchor plate in the rivet. The anchor plate has an underside surface which abuts the cover when the rivet, and thus the ring binder mechanism, is secured to the cover. By way of such an arrangement, the ring binder mechanism can withstand a larger sideward pulling force.

It is an object of the present invention to provide an improved ring binder mechanism, and a relevant securing device, which can withstand still larger pulling force, or at least to provide the consumers with a useful alternative.

According to a first aspect of the present invention, there is provided a ring binder mechanism adapted to be secured to an article, said ring binder mechanism comprising a substantially rigid housing supporting a pair of pivotable members to which a plurality of half-ring members are mounted, and securing means for engagement with the article, wherein the pivotable members are pivotably movable between a first configuration in which the half-ring members are closed, and a second configuration in which the half-ring members are open, wherein the securing means comprises a plate member adapted to abut the article, and wherein at least one securing member depends from at least one side edge of the plate member to secure the ring binder mechanism to the article.

According to a second aspect of the present invention, there is provided a securing device for securing a ring binder mechanism to an article, wherein the securing device comprises a plate member adapted to abut the article, and wherein at least one securing member depends from at least one side edge of the plate member to secure the ring binder mechanism to the article.

Embodiments of the above invention will now be described with reference to the accompanying drawings wherein.

Figure 1:
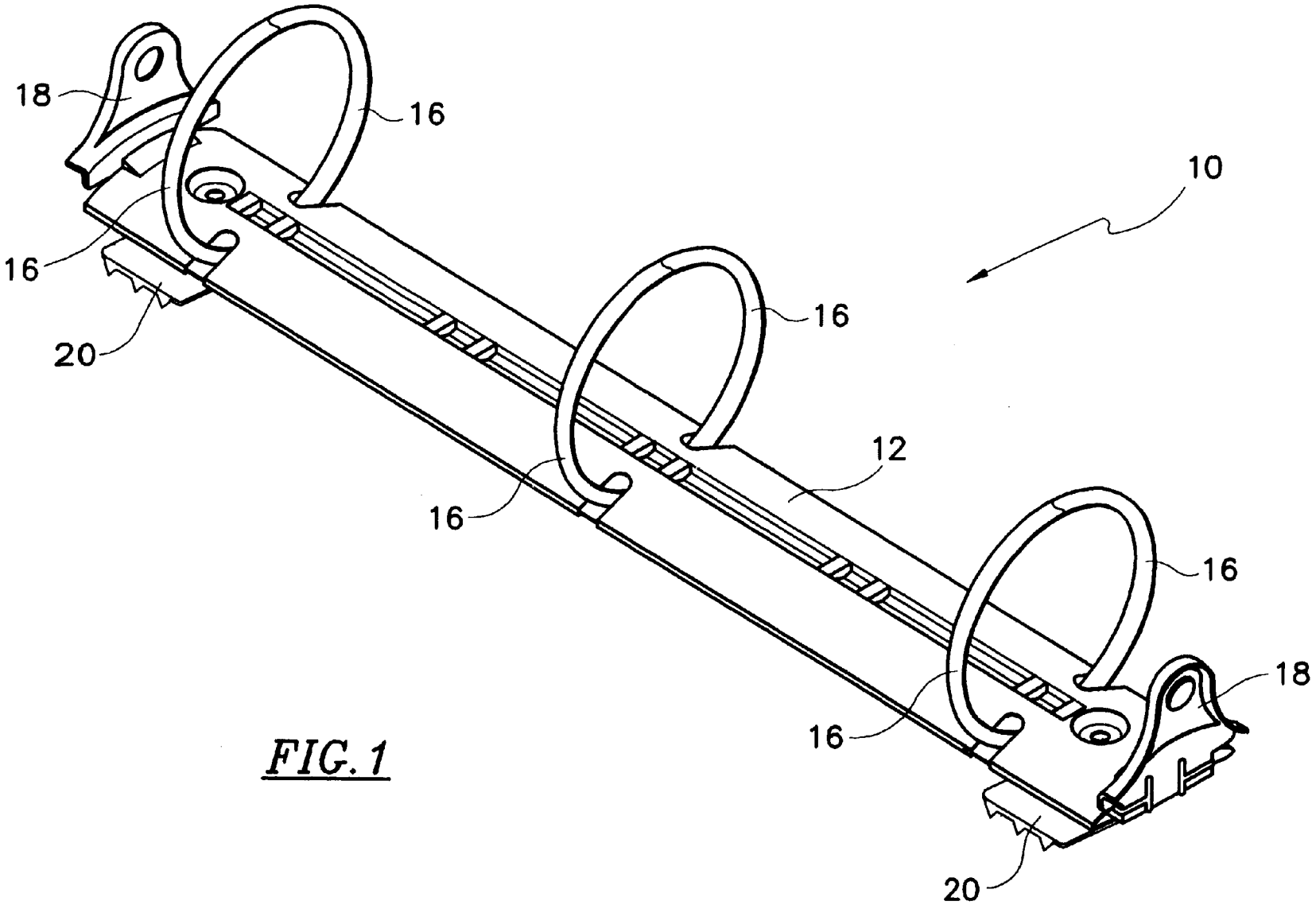
FIG. 1 is a top perspective view of a first embodiment of a ring binder mechanism according to the present invention.
Figure 2:
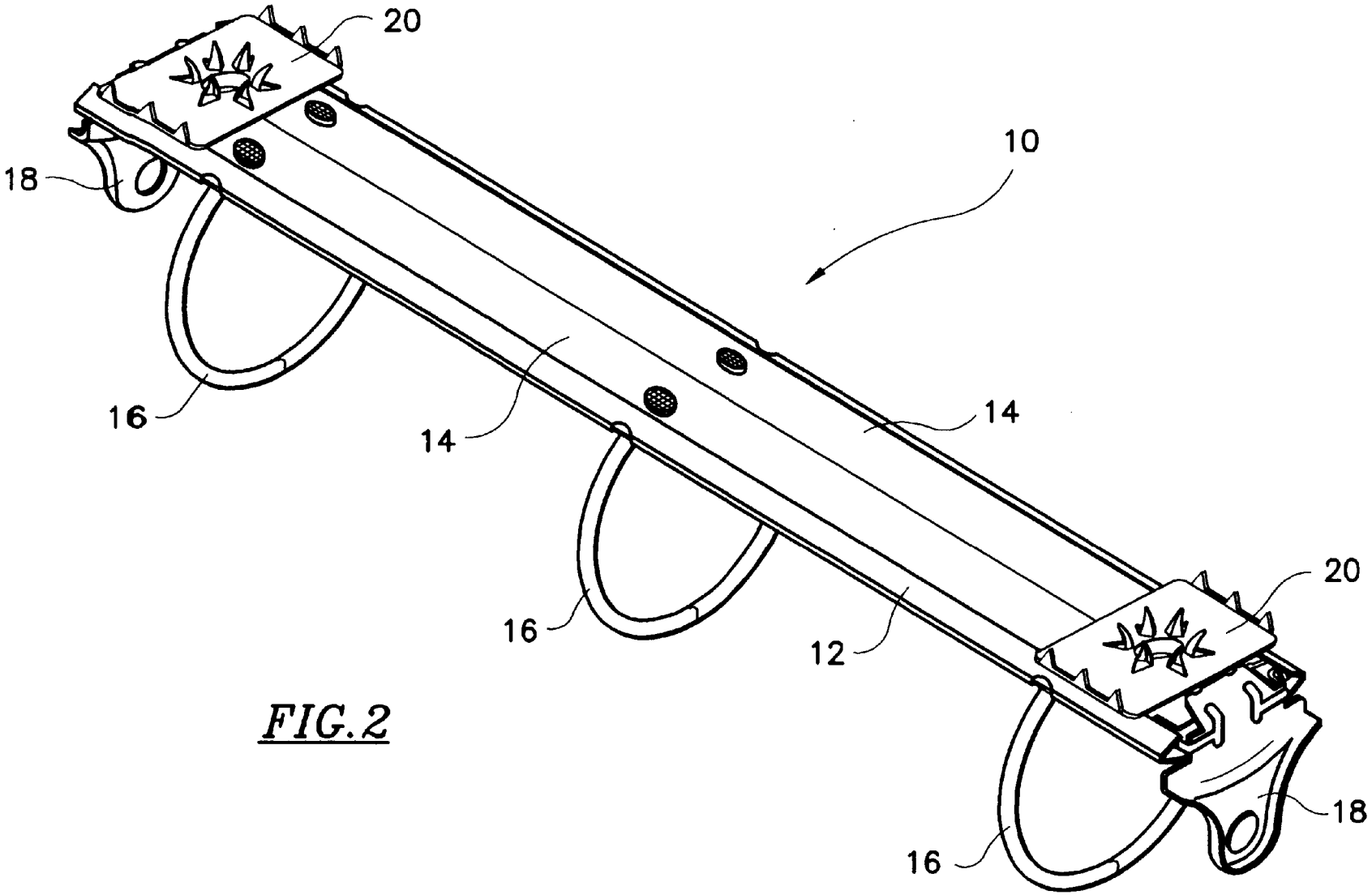
FIG. 2 is a bottom perspective view of the ring binder mechanism shown in FIG. 1.

As shown in FIGS. 1 and 2, a first embodiment of a ring binder mechanism according to the present invention is generally designated as 10. The ring binder mechanism includes a curved cover 12 supporting a pair of plates 14. To each of the plates 14 are fixedly attached three half-rings 16. At each longitudinal end of the ring binder mechanism 10 is an operating lever 18, which may be pivoted outward to pivot the plates, and thereby to open the half-rings 16. The half-rings 16 may be closed when being pushed towards each other.

Figure 5B:
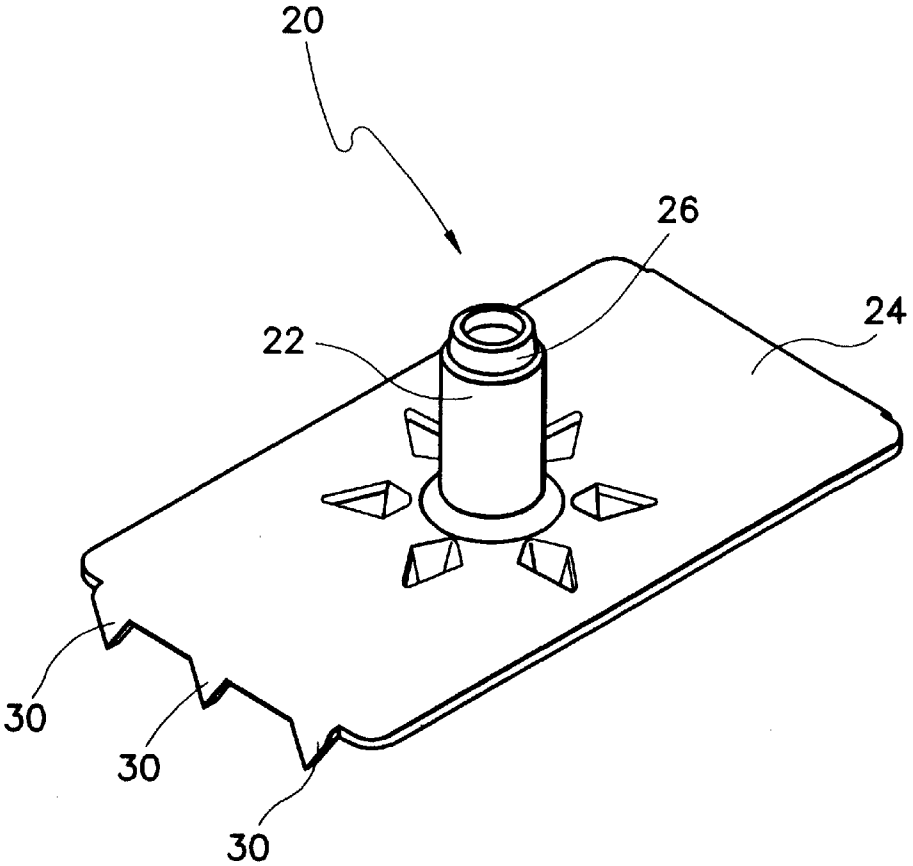
FIG. 5B is a top perspective view of the securing device shown in FIG. 5A.
Figure 5A:
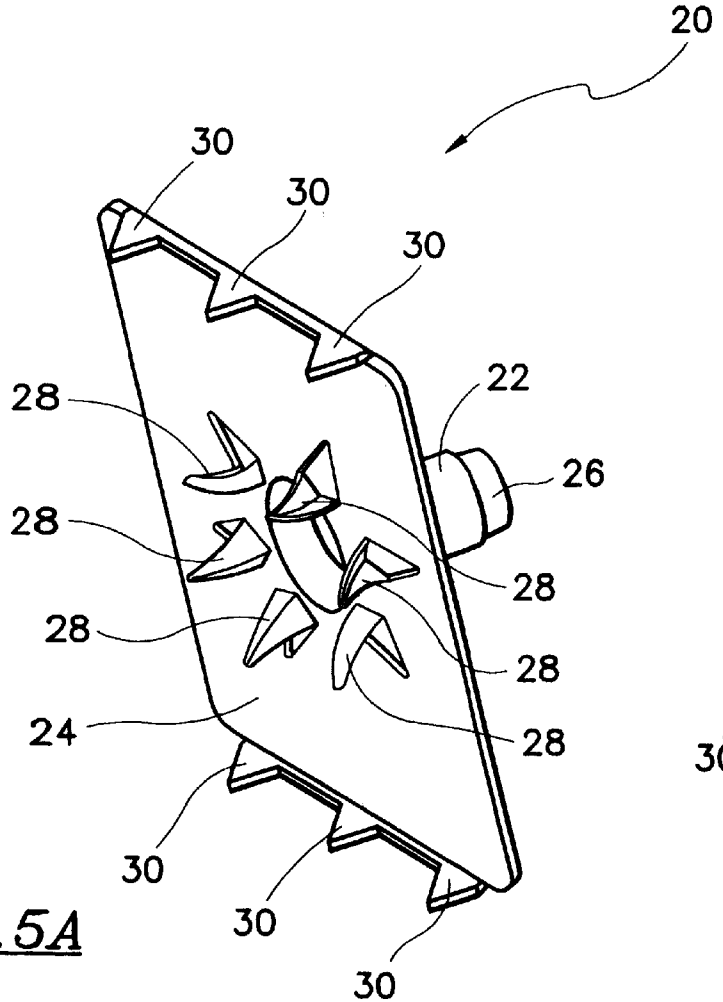
FIG. 5A is a bottom perspective view of a first embodiment of a securing device as used in the ring binder mechanism shown in FIG. 1.
Figure 6:
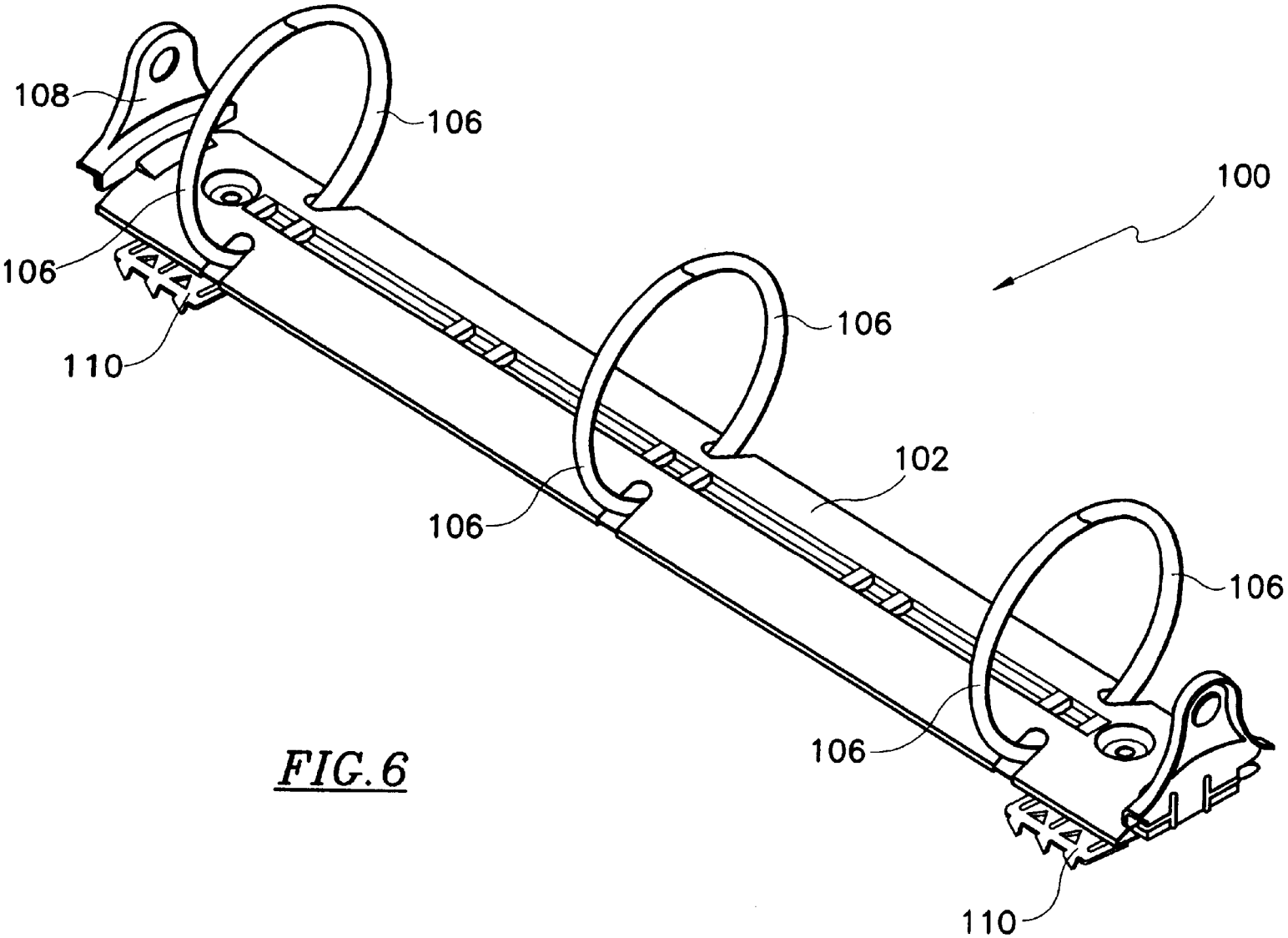
FIG. 6 is a top perspective view of a second embodiment of a ring binder mechanism according to the present invention.
Figure 7:
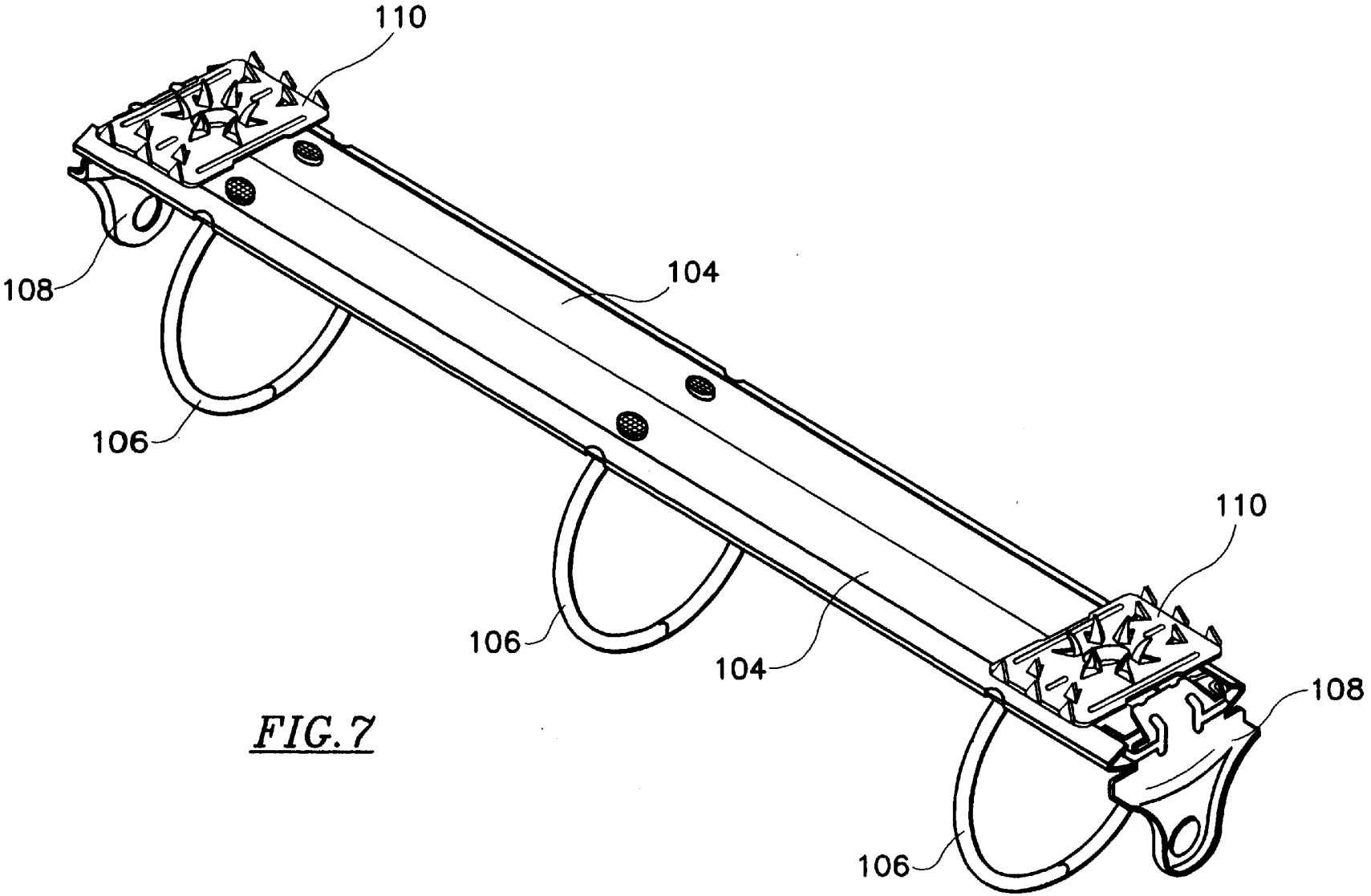
FIG. 7 is a bottom perspective view of the ring binder mechanism shown in FIG. 6.
Figure 8:
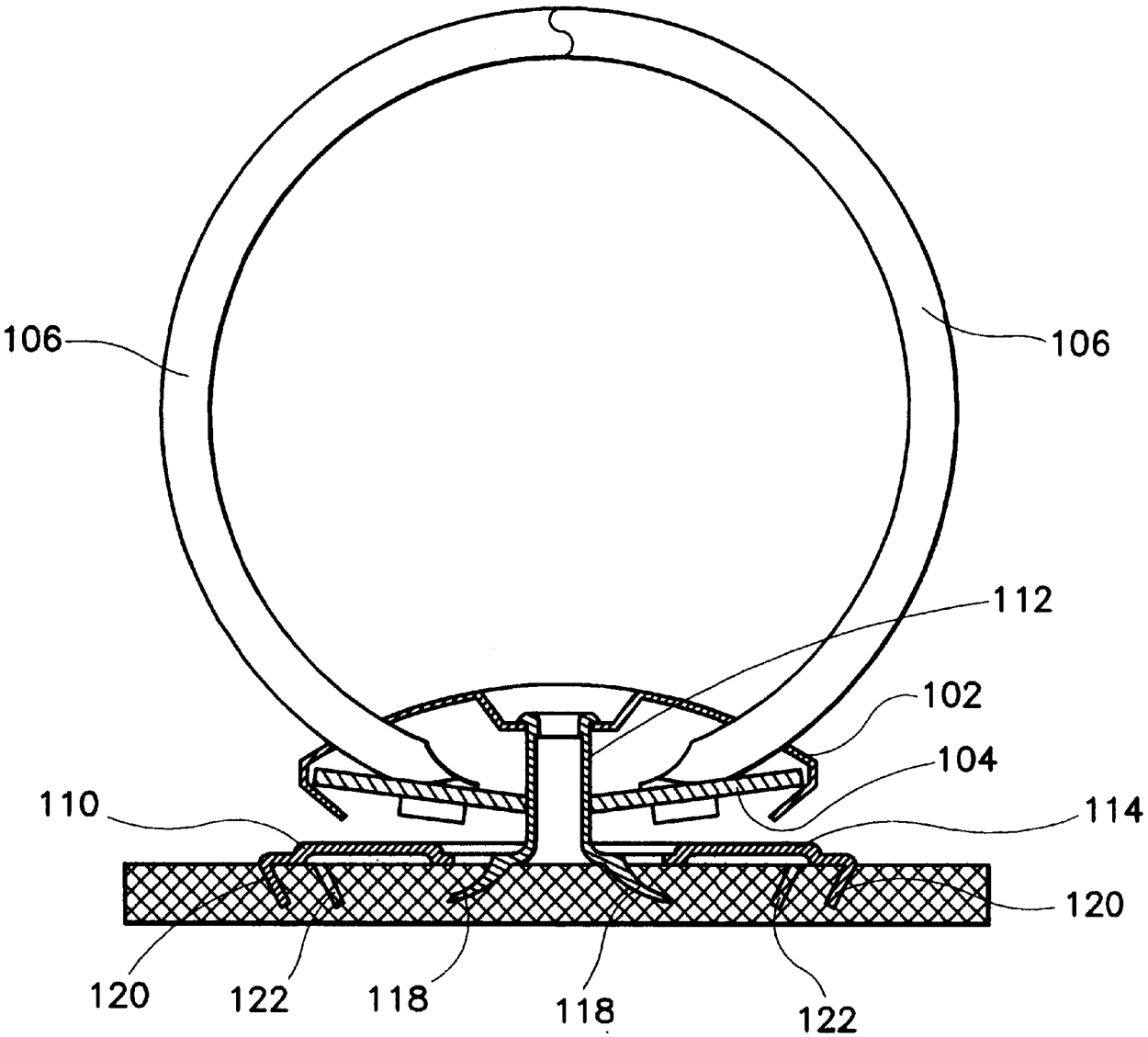
FIG. 8 is a transverse sectional view of the ring binder mechanism shown in FIG. 6.
Figure 9:
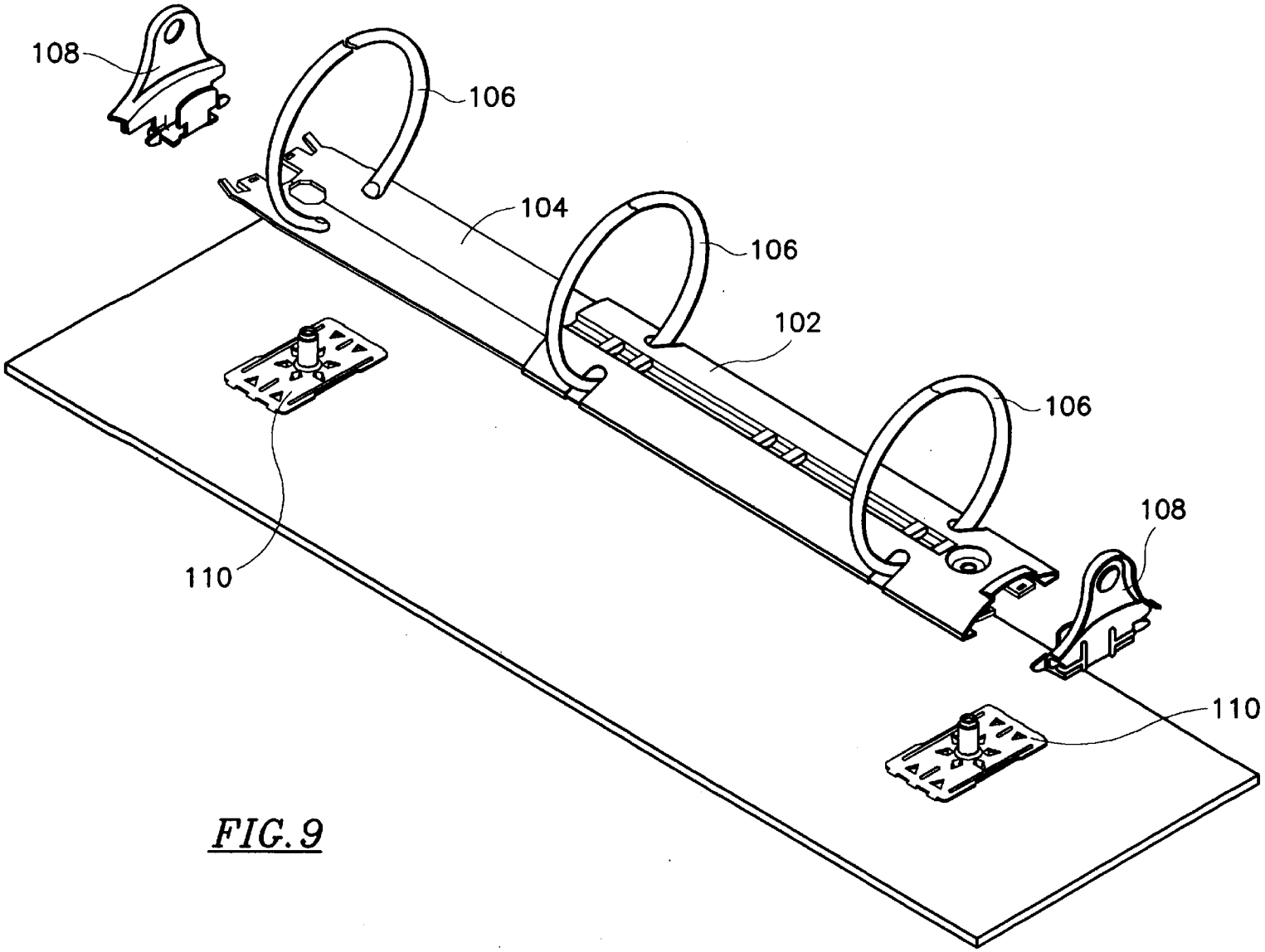
FIG. 9 is a partially exploded top perspective view of the ring binder mechanism shown in FIG. 6.

A rivet 20 is secured to the curved cover 12 adjacent each longitudinal end of the ring binder mechanism 10. As can be seen more clearly in FIGS. 5A and 5B, the rivet 20 includes a hollow post 22 which is substantially perpendicular to an anchor plate 24, which is of a substantially rectangular shape. The post 22 includes an open upper end 26 which may be deformed to engage the curved cover 12. Depending downward from and integral with the anchor plate 24 are six central claws 28. The central claws 28 extend and curve generally away from the longitudinal axis of the post 22.

Depending downward from two opposite side edges of the anchor plate 24 are six side claws 30, with three side claws 30 on each side. The side claws are substantially perpendicular to the surface of the anchor plate 24. The post 22, the anchor plate 24, the central claws 28 and the side claws 30 are all integrally formed.

Figure 3:
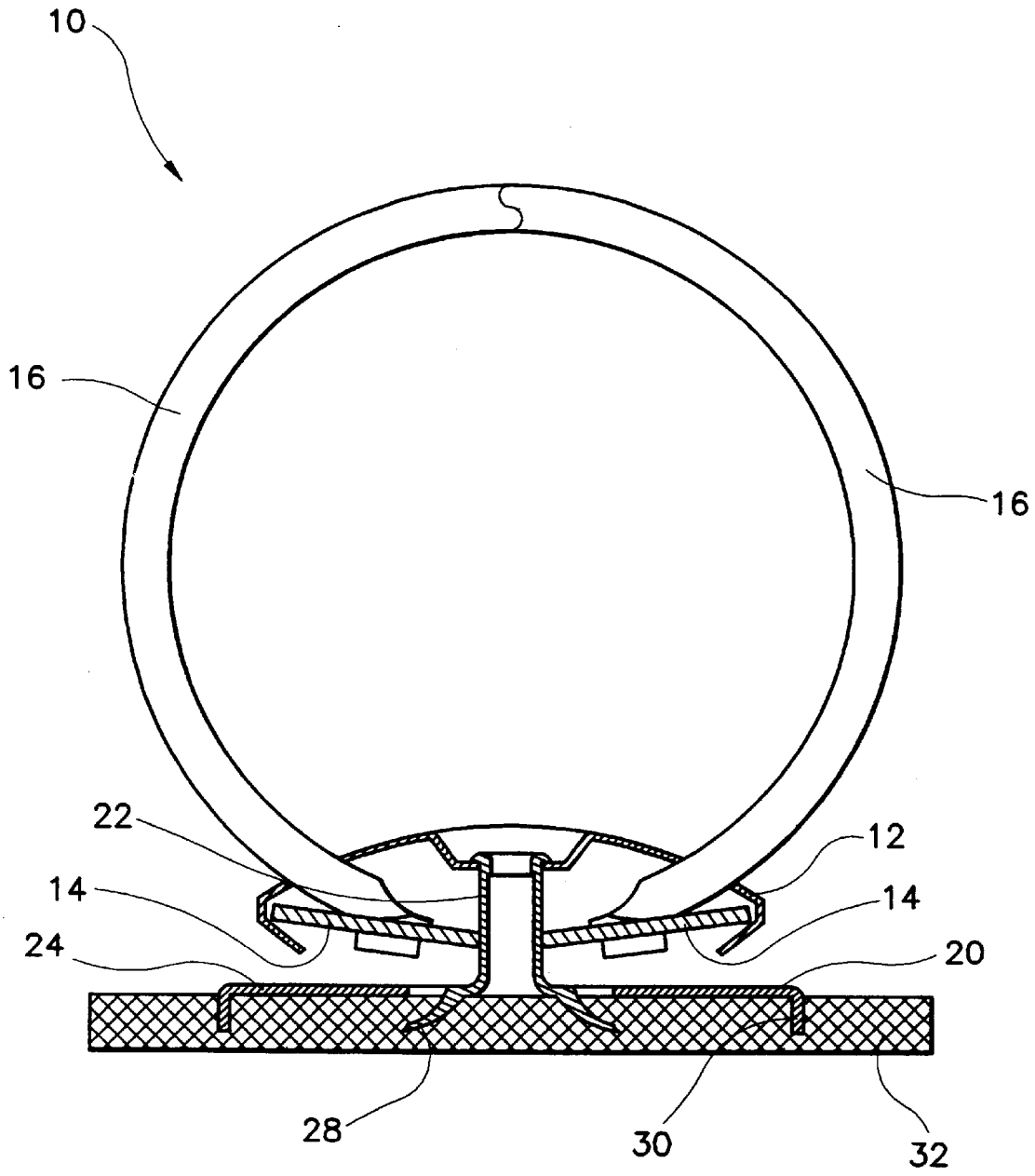
FIG. 3 is a transverse sectional view of the ring binder mechanism shown in FIG. 1.
Figure 4:
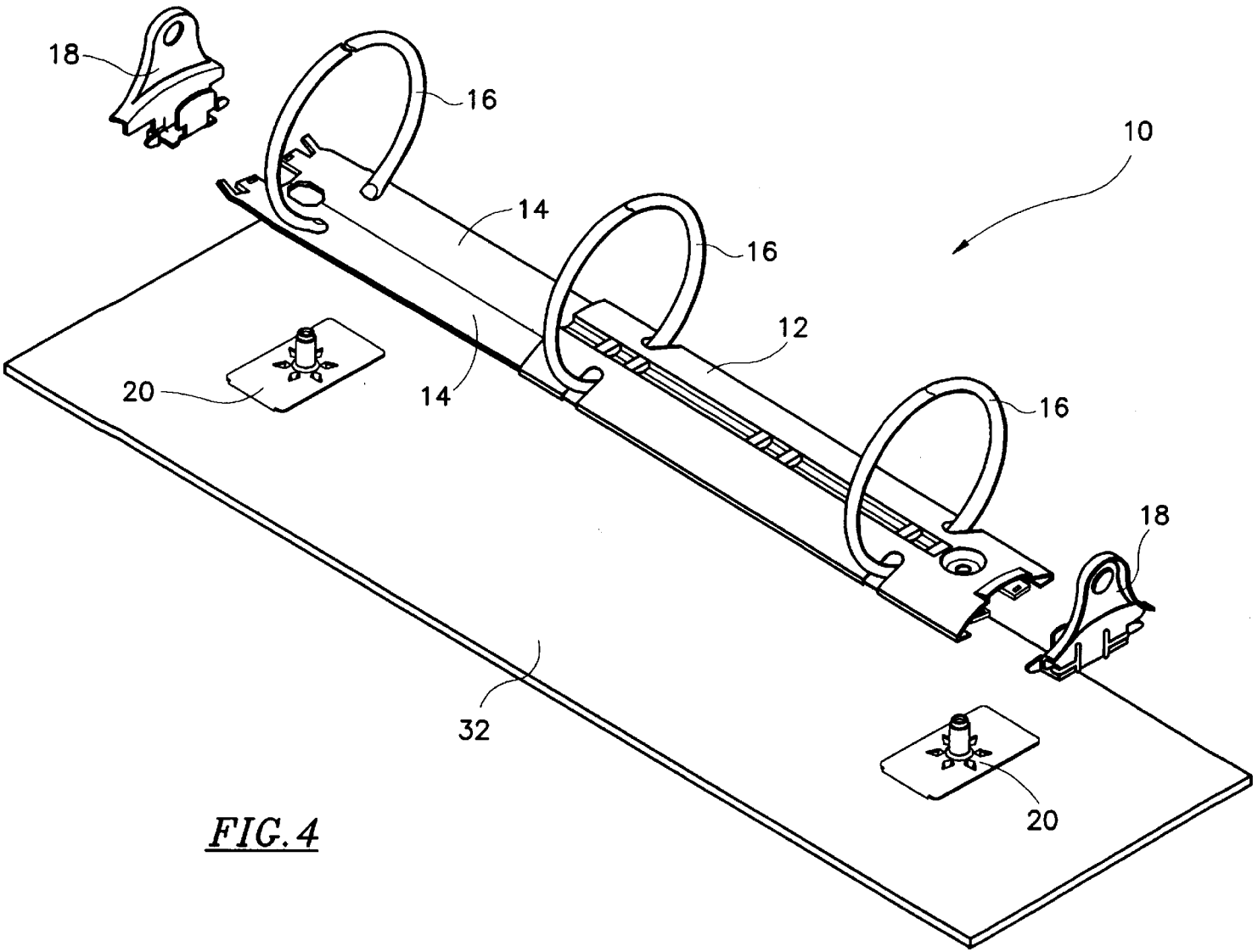
FIG. 4 is a partially exploded top perspective view of the ring binder mechanism shown in FIG. 1.

As shown in FIGS. 3 and 4, the ring binder mechanism 10 may be secured to a cover 32, which may be made of cardboard or PVC (polyvinyl chloride), by the rivets 20. It can be seen that the central claws 28 and the side claws 30 penetrate the cover 32, and hold the ring binder mechanism 10 against movement relative to the cover 32. To further enhance the engagement between the rivets 20 and the cover 32, the rivets 20 are wider than the curved cover 20. Each lateral side of the rivets 20 extends beyond a respective lateral side of the curved cover 12.

As shown in FIGS. 6 to 9, a ring binder mechanism according to a second embodiment of the present invention is generally designated as 100. As in the ring binder mechanism 10 shown in FIGS. 1 to 5B, the ring binder mechanism 100 includes a curved cover 102 supporting a pair of plates 104. To each of the plates 104 are fixedly attached three half-rings 106. At each longitudinal end of the ring binder mechanism 100 is provided an operating lever 108.

Figure 10B:
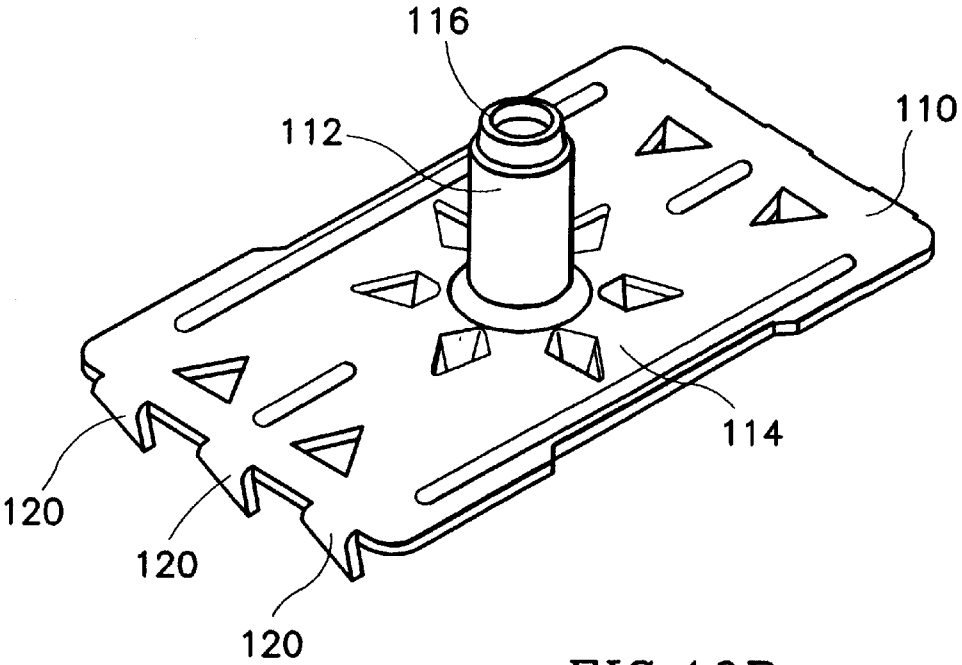
FIG. 10B is a top perspective view of the securing device shown in FIG. 10A.
Figure 10A:
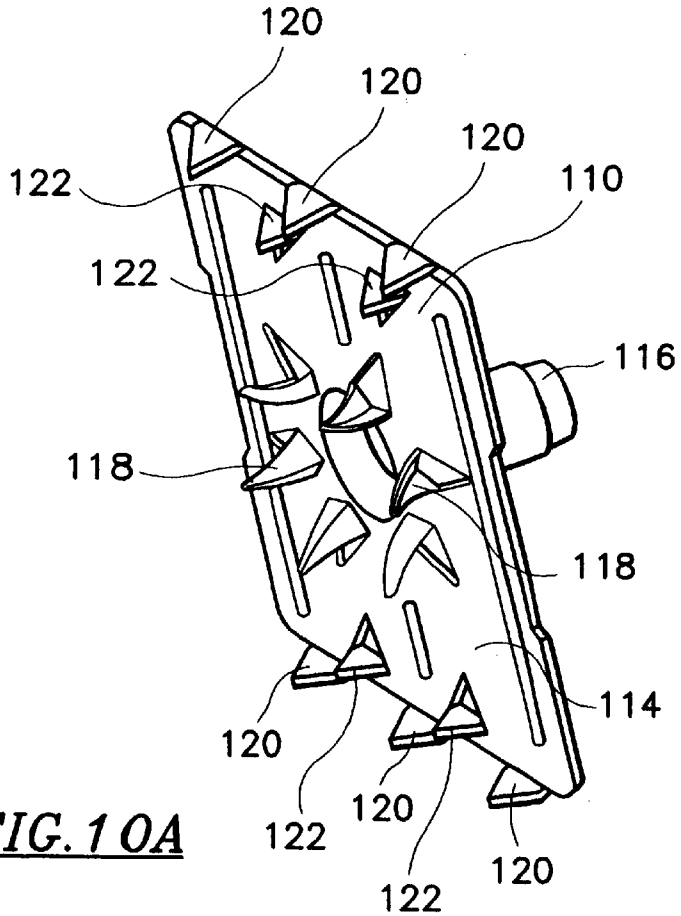
FIG. 10A is a bottom perspective view of a second embodiment of a securing device as used in the ring binder mechanism shown in FIG. 6.
Figure 11:
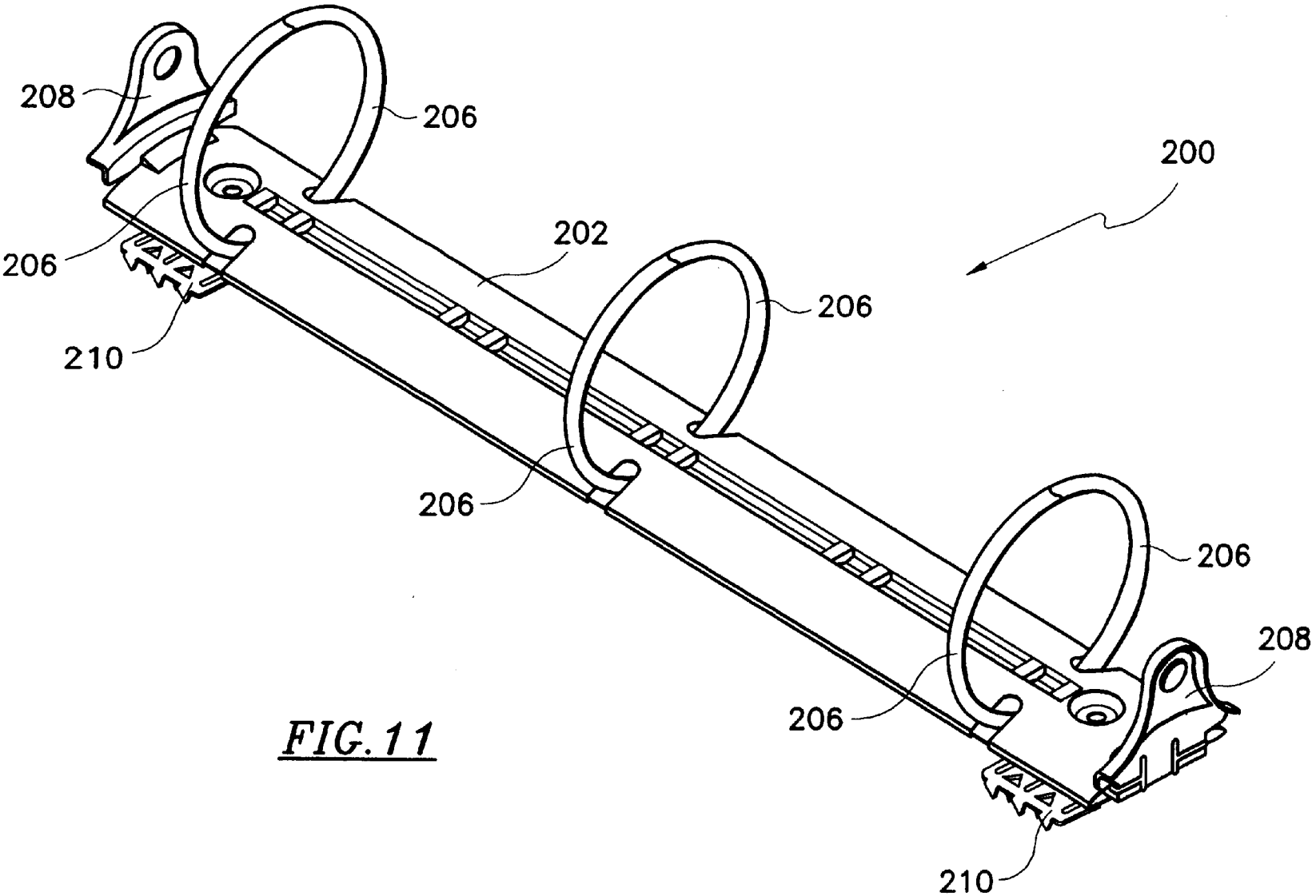
FIG. 11 is a top perspective view of a third embodiment of a ring binder mechanism according to the present invention.
Figure 12:
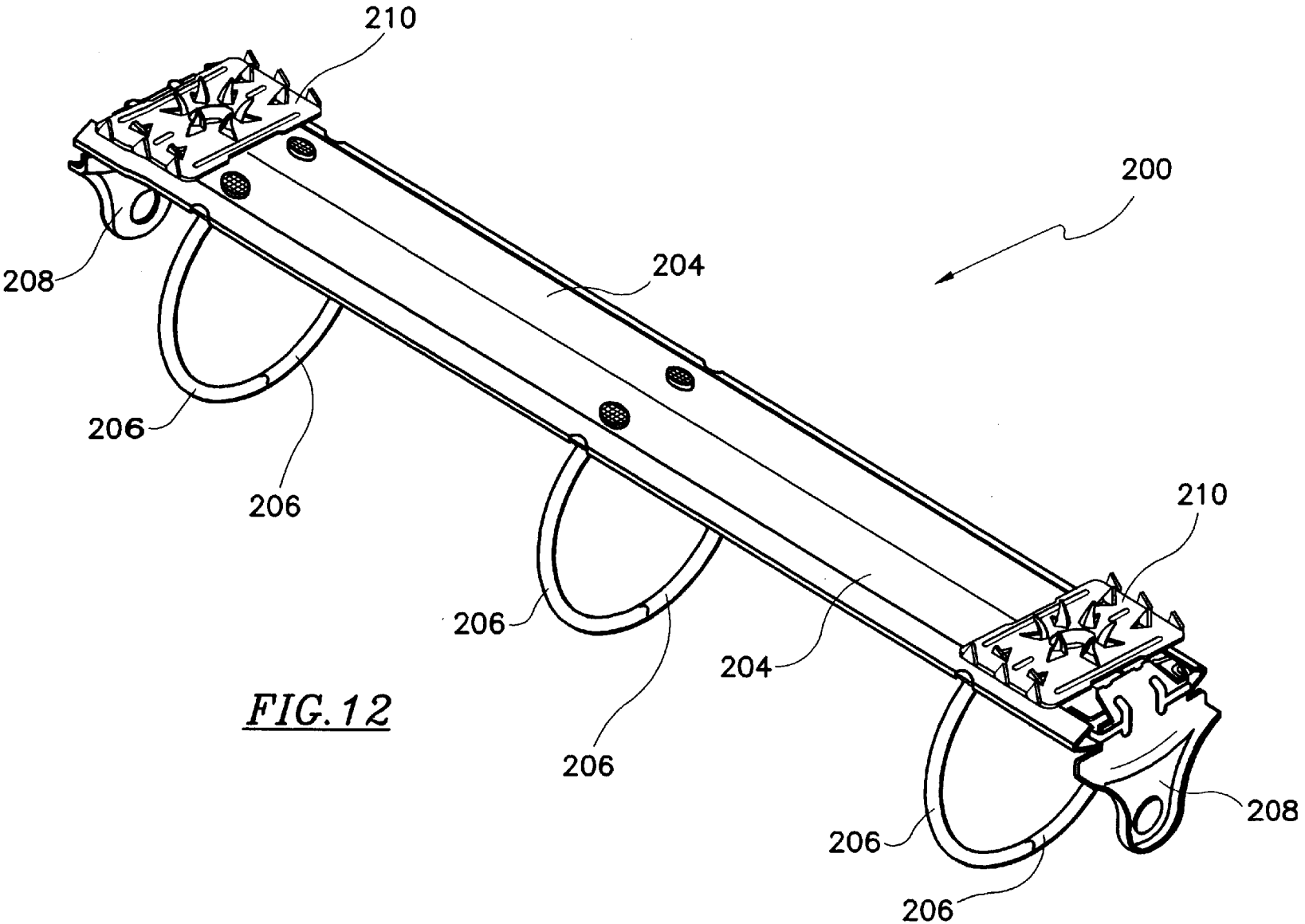
FIG. 12 is a bottom perspective view of the ring binder mechanism shown in FIG. 11.
Figure 13:
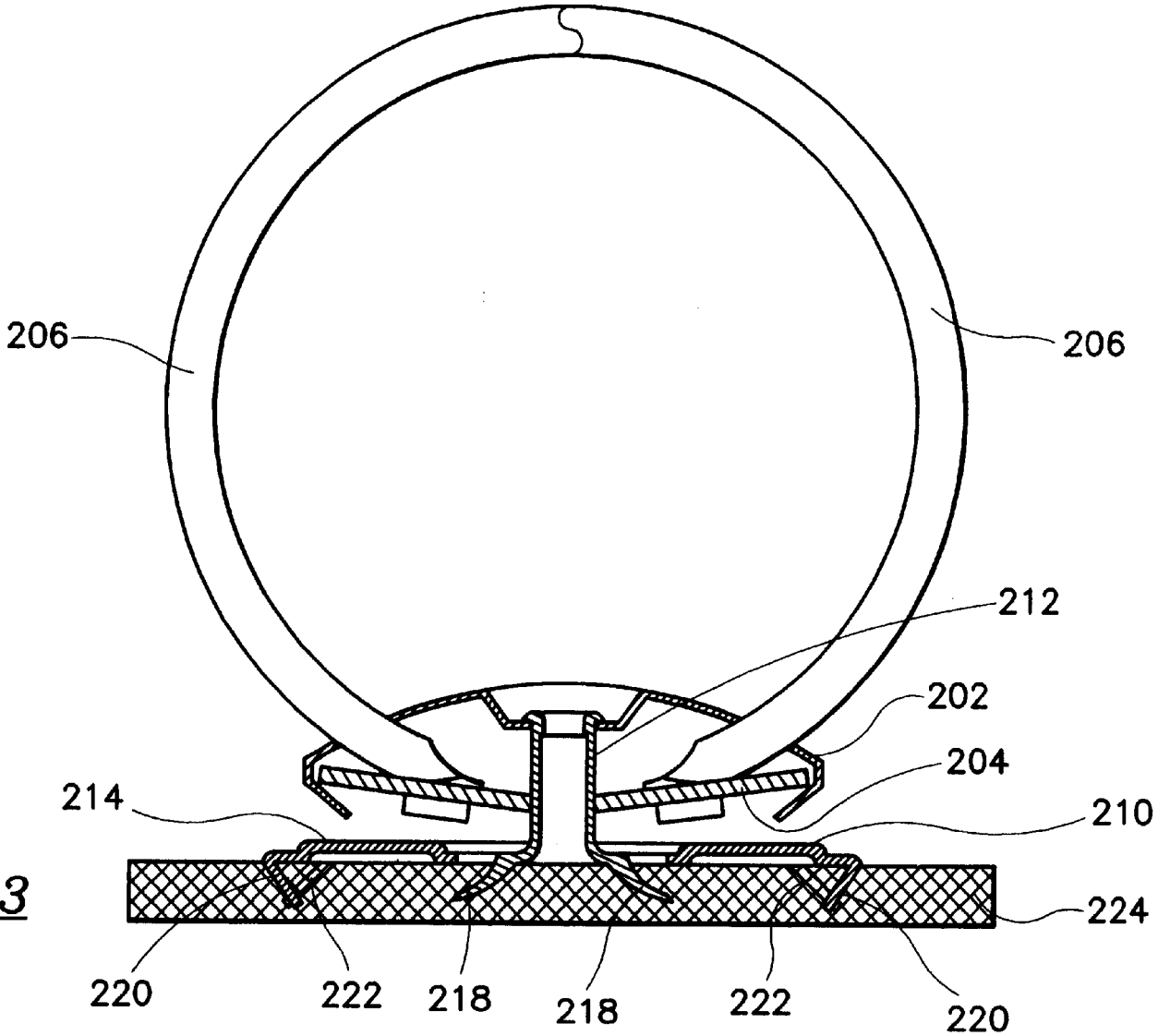
FIG. 13 is a transverse sectional view of the ring binder mechanism shown in FIG. 11.
Figure 14:
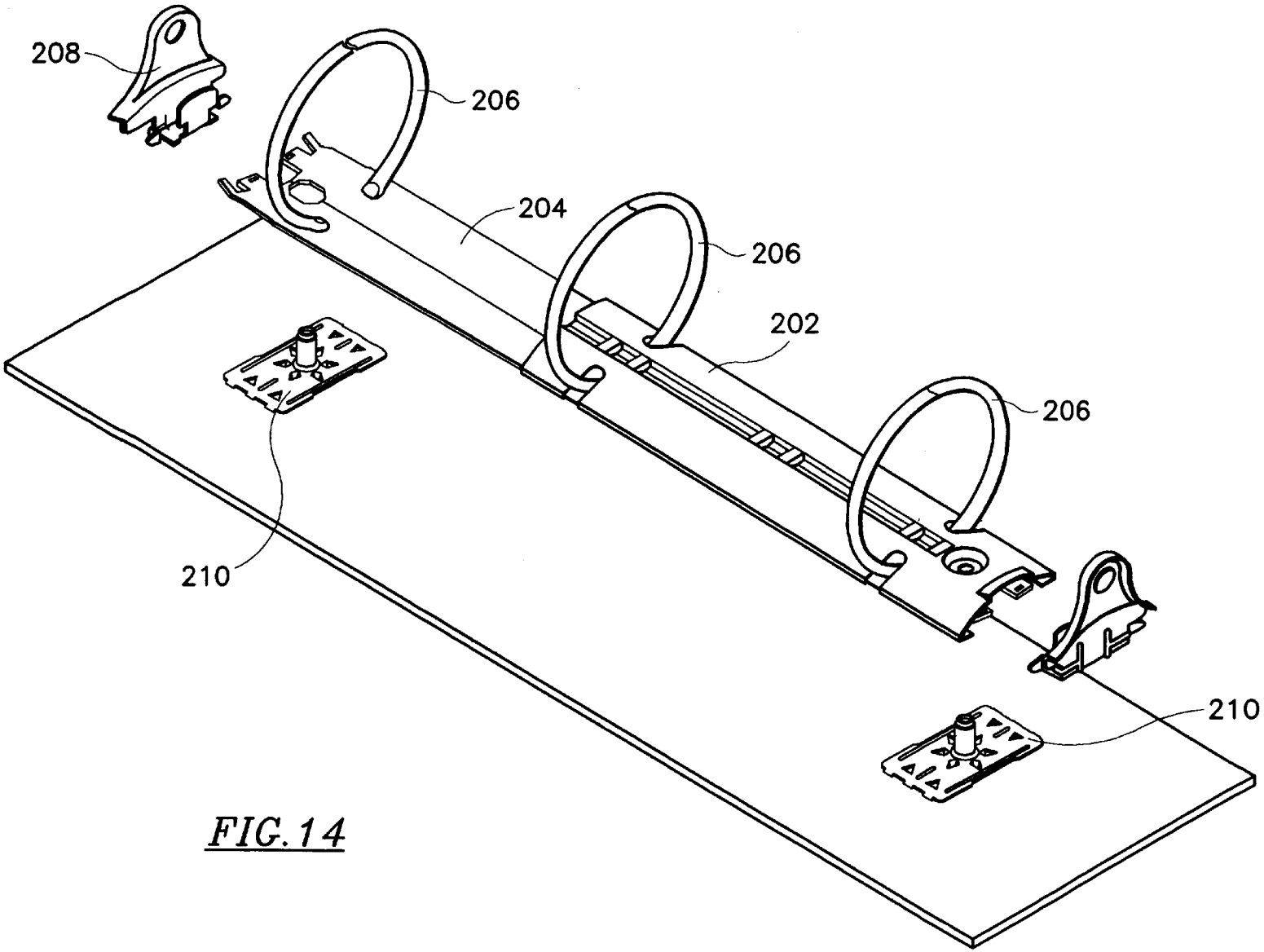
FIG. 14 is a partially exploded top perspective view of the ring binder mechanism shown in FIG. 11.

A rivet 110 is secured to the curved cover 102 adjacent each longitudinal end of the ring binder mechanism 100. As can be seen more clearly in FIGS. 10A and 10B, the rivet 110 includes a central hollow post 112 which is substantially perpendicular to a substantially rectangular anchor plate 114. The post 112 includes an open end 116 which may be deformed to engage the curved cover 102. Depending from and integral with the anchor plate 114 are six central claws 118, which extend and curve generally away from the longitudinal axis of the post 112.

Depending downward from two opposite side edges of the anchor plate 114 are six outer claws 120, with a row of three outer claws 120 on each side edge. The two rows of outer claws 120 on the respective side edges of the anchor plate 114 extend towards each other, and generally towards the central hollow post 112. A row of two inner claws 122 are arranged alongside and adjacent each of the rows of outer claws 120. The row of inner claws 122 generally extend towards the same direction as with the adjacent row of outer claws 120. As both the inner claws 122 and the outer claws 120 point towards the same direction, the angle between the anchor plate 114 and each of the outer claws 120 and inner claws 122 is roughly the same. The central hollow post 112, the anchor plate 114, the central claws 118, the outer claws 120 and the inner claws 122 are all integrally formed.

Turning to FIGS. 11 to 14, a ring binder mechanism according to a third embodiment of the present invention is generally designated as 200. As in the ring binder mechanism 10 shown in FIGS. 1 to 5B, the ring binder mechanism 200 includes a curved cover 202 supporting a pair of plates 204. To each of the plates 204 are fixedly attached three half-rings 206. At each longitudinal end of the ring binder mechanism 200 is provided an operating lever 208.

Figure 15B:
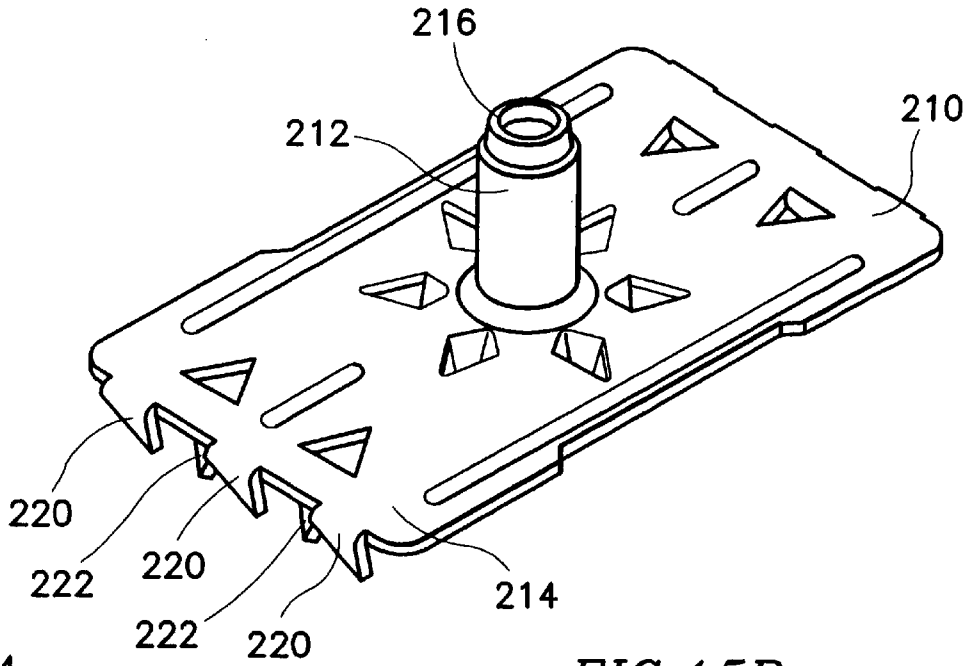
FIG. 15B is a top perspective view of the securing device shown in FIG. 15A.
Figure 15A:
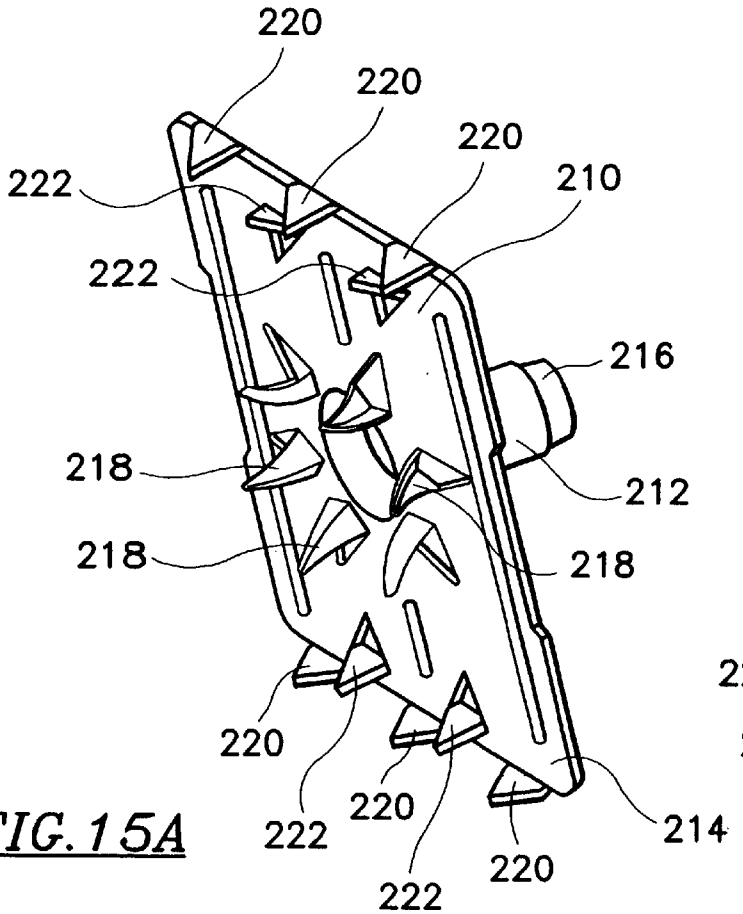
FIG. 15A is a bottom perspective view of a third embodiment of a securing device as used in the ring binder mechanism shown in FIG. 11.

A rivet 210 is secured to the curved cover 202 adjacent each longitudinal end of the ring binder mechanism 200. As can be seen more clearly in FIGS. 15A and 15B, the rivet 210 includes a central hollow post 212 which is substantially perpendicular to a substantially rectangular anchor plate 214. The post 212 includes an open end 216 which may be deformed to engage the curved cover 202. Depending from and integral with the anchor plate 214 are six central claws 218, which extend and curve generally away from the longitudinal axis of the post 212.

Depending downward from two opposite side edges of the anchor plate 214 are six outer claws 220, with a row of three outer claws 220 on each side edge. The two rows of outer claws 220 on the respective side edges of the anchor plate 214 extend towards each other, and generally towards the central hollow post 212. A row of two inner claws 222 are arranged alongside and adjacent each of the rows of outer claws 220. The row of inner claws 222 generally extend towards the adjacent row of outer claws 220. The row of outer claws 220 and the adjacent row of inner claws 222 point towards each other. The central hollow post 212, the anchor plate 214, the central claws 218, the outer claws 220 and the inner claws 222 are all integrally formed.

With the arrangements discussed above, when pulling force in a sideward direction (i.e. transverse to the longitudinal axis of the ring binder mechanism 10, 100 or 200) is applied on the ring binder mechanism 10, 100 or 200, the force-bearing points are located at the lateral side edges of the anchor plate 14, 114 or 214, which are further away from the longitudinal axis of the ring binder mechanism 10, 100 or 200, when compared with conventional ring binder mechanisms. By way of such arrangements, the sideward pulling force which the ring binder mechanism 10, 100 or 200 can withstand is greatly increased. It should be noted in particular from FIG. 13 that when the rivet 210 is engaged with a cover 224, which may be made of paper or PVC (polyvinyl chloride), the rows of outer claws 220 and the adjacent row of inner claws 222 point towards each other, thus significantly enhances the gripping function of the rivet 210.

It should be understood that the above only describes embodiments of the present invention, and that alterations and modifications may be made thereto without departing from the spirit of the invention.

What is claimed is:

1. A ring binder mechanism adapted to be secured to an article, said ring binder mechanism comprising a substantially rigid housing supporting a pair of pivotable members to which a plurality of half-ring members are mounted, and securing means for engagement with the article, wherein the pivotable members are pivotably movable between a first configuration in which the half-ring members are closed, and a second configuration in which the half-ring members are open, wherein the securing means comprises a plate member adapted to abut the article, and wherein at least one securing member depends from at least one side edge of the plate member to secure the ring binder mechanism to the article.

2. A ring binder mechanism according to claim 1 wherein at least one securing member depends from each of at least two side edges of the plate member.

3. A ring binder mechanism according to claim 1 wherein at least one securing member is substantially perpendicular to a major surface of the plate member.

4. A ring binder mechanism according to claim 1 wherein at least one securing member extends towards the longitudinal axis of the housing.

5. A ring binder mechanism according to claim 1 wherein at least three securing members depend from the at least one side edge of the plate member.

6. A ring binder mechanism according to claim 5 wherein at least three securing members depend from each of two side edges of the plate member.

7. A ring binder mechanism according to claim 4 wherein the securing means further comprises at least one securing member depending from a major surface, and inward of at least one side edge, of the plate member.

8. A ring binder mechanism according to claim 7 wherein the securing member(s) depending from the major surface, and inward of the at least one side edge, of the plate member extend(s) towards the longitudinal axis of the housing.

9. A ring binder mechanism according to claim 7 wherein the securing member(s) depending from the major surface, and inward of the at least one side edge, of the plate member extend(s) away from the longitudinal axis of the housing.

10. A ring binder mechanism according to claim 7 wherein at least two securing members depend from the major surface, and inward of the at least one side edge, of the plate member.

11. A ring binder mechanism according to claim 1 wherein at least part of the securing member is adapted to penetrate the article and thereby to secure the ring binder mechanism to the article.

12. A ring binder mechanism according to claim 2 wherein the plate member is substantially rectangular and the two side edges from which the securing members depend are opposite to each other.

13. A ring binder mechanism according to claim 12 wherein the two side edges of the plate member from which the securing members depend are on opposite sides of the longitudinal axis of the housing.

14. A ring binder mechanism according to claim 1 wherein the linear measure of the plate member transverse to the longitudinal axis of the housing is greater than the width of at least part of the housing.

15. A ring binder mechanism according to claim 14 wherein the plate member comprises at least two side edges, each extending beyond a respective lateral side of the housing.

16. A ring binder mechanism according to claim 1 wherein the securing member comprises a claw member.

17. A ring binder mechanism according to claim 1 further comprising two securing means.

18. A ring binder mechanism securing device for securing a ring binder mechanism to an article comprising:

a plate member adapted to abut the article, and wherein at least one securing member depends from at least one side edge of the plate member to secure the ring binder mechanism to the article.

19. A ring binder mechanism securing device according to claim 18 wherein at least one securing member depends from each of at least two side edges of the plate member.

20. A ring binder mechanism securing device according to claim 18 wherein at least one securing member is substantially perpendicular to a major surface of the plate member.

21. A ring binder mechanism securing device according to claim 18 wherein at least one securing member extends inward of the at least one side edge of the plate member.

22. A ring binder mechanism securing device according to claim 18 wherein at least three securing members depend from the at least one side edge of the plate member.

23. A ring binder mechanism securing device according to claim 22 wherein at least three securing members depend from each of two side edges of the plate member.

24. A ring binder mechanism securing device according to claim 21 wherein the ring binder mechanism securing device further comprises at least one securing member depending from a major surface, and inward of at least one side edge, of the plate member.

25. A ring binder mechanism securing device according to claim 24 wherein the securing member(s) depending from the major surface, and inward of the at least one side edge, of the plate member, extend(s) inward of the at least one side edge of the plate member.

26. A ring binder mechanism securing device according to claim 24 wherein the securing member(s) depending from the major surface, and inward of the at least one side edge, of the plate member, extend(s) outward of the at least one side edge of the plate member.

27. A ring binder mechanism securing device according to claim 24 wherein at least two securing members depend from the major surface, and inward of the at least one side edge, of the plate member.

28. A ring binder mechanism securing device according to claim 18 wherein at least part of the securing member is adapted to penetrate the article and thereby to secure the ring binder mechanism to the article.

29. A ring binder mechanism securing device according to claim 19 wherein the plate member is substantially rectangular and the two side edges from which the securing members depend are opposite to each other.

30. A ring binder mechanism securing device according to claim 18 wherein the securing member comprises a claw member.

* * * * *